US005788016A

United States Patent [19]

Soulas et al.

[11] Patent Number: 5,788,016

[45] Date of Patent: Aug. 4, 1998

[54] LIFTING FRAME FOR AN INDUSTRIAL TRUCK

[75] Inventors: Frank Soulas, Colombiers; Guy Cartier, Chalais, both of France; Jürgen Roth, Sailauf, Germany

[73] Assignee: Linde Aktiengesellschaft, Germany

[21] Appl. No.: 682,856

[22] Filed: Jul. 12, 1996

[51] Int. Cl.[6] ..... B66F 9/08

[52] U.S. Cl. ..... 187/238; 414/631

[58] Field of Search ..... 187/238, 237, 187/222; 414/631, 629

[56] References Cited

U.S. PATENT DOCUMENTS 4,034,855 7/1977 Stedman ..... 187/238

*Primary Examiner*—Kenneth Noland

*Attorney, Agent, or Firm*—Webb Ziesenheim Bruening Logsdon Orkin & Hanson, P.C.

[57] ABSTRACT

A lifting carriage for use on an industrial truck is connected to a lifting frame which moves vertically along a lift mast. The lifting carriage includes a rotatable guide roller arrangement for adjusting the position of the lifting carriage. The guide roller arrangement includes a first pair of horizontally spaced guide rollers and a second pair of horizontally spaced guide rollers which are vertically spaced from the first pair of horizontally spaced guide rollers. The position of guide rollers of the first pair of guide rollers is not movable relative to the lifting carriage and the position of the guide rollers of the second pair of guide rollers is movable relative to the lifting carriage in a direction having a horizontal component.

18 Claims, 3 Drawing Sheets

LIFTING FRAME FOR AN INDUSTRIAL TRUCK

This invention relates generally to an adjustable lifting carriage for use on an industrial truck and, more particularly, to a lifting carriage which is adjustably mounted on the lifting frame which is vertically movable along the lift mast of an industrial truck. The lifting carriage includes at least one pair of horizontally spaced rotatable guide rollers and at least two pairs of rotatable guide rollers which are vertically spaced and are adapted to be supported in a lifting frame.

BACKGROUND OF THE INVENTION

1. Field of the Invention

In the type of industrial truck under consideration, the lifting carriage is mounted on a lifting frame which is moved vertically along a lift mast by a chain and is moved horizontally by guide rollers. A load suspension means such as a fork arrangement is fastened to the lifting carriage to suspend, lift and transport loads and moves vertically with the lifting carriage. The load suspension means is fastened to the lifting carriage by means of a fork carrier. If the load suspension means are a fork arrangement, a plurality of fork arms are generally fastened to the fork carrier independently of one another and are fixed in position. The fork carrier can either be formed unitary with the lifting carriage or can be a separate component connected to the lifting carriage.

2. Related Prior Art

In prior art industrial trucks, when forks are used as the load suspension means, it is advantageous if the inclination of the load suspension means relative to a horizontal plane can be adjusted during the operation of the industrial truck. For example, when carrying loads with minimum ground clearance, it is advantageous if the forks can be tilted forwardly to lower the tips of the fork arms. In contrast, when the load on the forks is elevated, the stability of the industrial truck can be increased by tilting the forks rearwardly to raise the tips of the fork arms.

In order to vary the inclination of the load suspension means of an industrial truck, the prior art discloses systems in which the entire lifting frame can be inclined or tipped forwardly and rearwardly. Prior art industrial trucks which have a lifting frame which cannot be tilted include an arrangement to connect the fork carrier onto the lifting carriage as a separate component, and a device is provided to rotate the fork carrier around a horizontal axis relative to the lifting carriage. In this arrangement, the industrial truck has a large and heavy forward part located in front of the lifting frame which creates an unfavorable weight distribution and limits the load-carrying capacity of the industrial truck.

SUMMARY OF THE INVENTION

An object of the present invention is to provide an industrial truck having a stationary lift mast and maximum load-carrying capacity wherein the load suspension means can be inclined or tilted both forwardly and rearwardly. This object is accomplished according to the invention by providing at least one guide roller on the lifting carriage which can be moved relative to the lifting carriage in a direction having a horizontal component.

The position of the guide rollers in the horizontal direction is defined by the lifting frame. Therefore, the movement of a guide roller relative to the lifting carriage causes a change in the absolute position of the lifting carriage. If the position of a first guide roller relative to the lifting carriage is changed in the horizontal direction and a second guide roller located at some distance from the first guide roller maintains its position relative to the lifting carriage in the vertical direction, the lifting carriage is inclined or tipped around a horizontal axis. The inclination of the load suspension means, e.g., the fork arms which are supported on the lifting carriage, is also changed.

In a preferred embodiment of the invention, at least one guide roller is fastened to an axle body which is rotatably mounted on the lifting carriage around an axis of rotation. The axis of rotation of the axle body and the axis of rotation of the guide roller which is fastened to the axle body are substantially parallel to one another and are spaced from one another. The guide roller which is mounted on the axle body prescribes an arc with respect to the lifting carriage. The vertical component of the arc is compensated for by the movement of the guide roller relative to the lifting frame while the horizontal component of the arc tips the lifting carriage relative to the lifting frame.

The lifting carriage is provided with a rotation device connected to the axle body to rotate the axle body relative to the lifting carriage around its axis of rotation. This rotation device applies a linear force to tip the lifting carriage, the load suspension means and a load carried on the load suspension means.

It is particularly appropriate if a crank pin is connected to the axle body and is spaced from the axis of rotation of the axle body. The crank pin makes it possible to transform a linear force created by the rotation device into the torque required to rotate the axle body relative to the lifting carriage about its axis of rotation. It is advantageous if the rotation device includes a linear actuator such as a hydraulic cylinder to generate a linear force. A hydraulic cylinder is advantageous because other hydraulic components are already present in the hydraulic circuit on an industrial truck.

It is particularly advantageous if the hydraulic cylinder has a piston rod having its distal end fastened to the crank pin of the axle body. The closed end of the hydraulic cylinder is pivotally connected to brackets on the lifting carriage. The hydraulic cylinder is thereby able to generate the torque required to rotate the axle housing while the counter-force is transmitted directly to the lifting carriage. The forces thereby remain within the confines of the lifting carriage and are not transmitted to the lifting frame. It is appropriate if the hydraulic cylinder is a dual-action cylinder which permits the load suspension means to be inclined or tipped in both directions.

In an embodiment of the invention, the lifting carriage is mounted on the lifting frame with four guide rollers. Two of the guide rollers are rotatably mounted on the lifting carriage coaxial to one another and the other two guide rollers are also rotatably mounted on the axle body coaxial to one another. This corresponds to the conventional arrangement of the guide rollers on the lifting frame of an industrial truck and makes it possible to easily retrofit conventional prior art industrial trucks with a lifting carriage according to the invention.

It is particularly advantageous if the lifting carriage of the invention includes two spaced substantially parallel legs on which the guide rollers and/or the axle body are rotatably mounted. The rotation device is located between the legs which places the center of gravity inside of the outline of the lifting frame and creates a favorable distribution of mass close to the industrial truck.

The axle body may consist of several parts which makes it easy to install and does not require complex or expensive mountings on the legs of the lifting carriage.

In a second embodiment of the invention, the guide roller which moves relative to the lifting carriage is located above the guide roller which is not movable relative to the lifting carriage. In this arrangement, when the tips of the forks are raised the center of gravity of the lifting carriage is moved toward the lifting frame which creates a favorable distribution of the mass supported on the lifting frame.

It is particularly advantageous if the lifting carriage is a fork carrier since the lifting carriage can be tilted relative to the lift mast and a separate tilting mechanism for the fork carrier is unnecessary. The result is a favorable distribution of mass close to the lifting frame.

A complete understanding of the invention will be obtained from the following description when taken in connection with the accompanying drawing figures wherein like reference characters identify like parts throughout.

DESCRIPTION OF THE PREFERRED EMBODIMENTS

Figure 3:
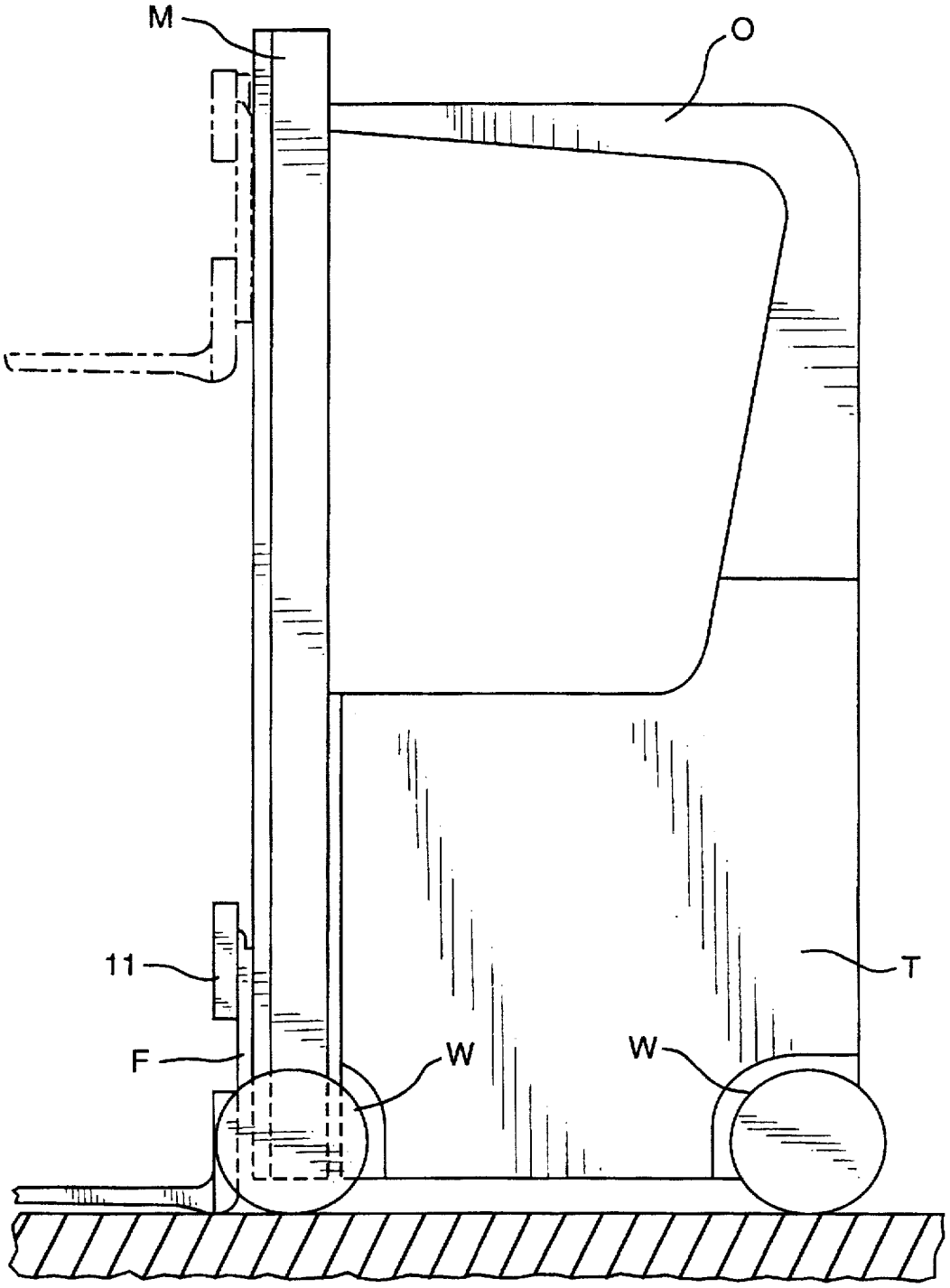
FIG. 3 is a schematic side elevation of an industrial truck showing a lifting carriage mounted on a lifting frame which is vertically movable along a lift mast.

The industrial truck T shown in FIG. 3 of the drawings includes a lifting carriage C mounted on a lifting frame F which is guided for vertical movement along a lift mast M. The lift mast M is supported on the front of the industrial truck T which includes an operator's cab O and forward and rear travel wheels W. The lifting carriage C is mounted on the lifting frame F by the four guide rollers 1*a* and 1*b*. The guide rollers 1*a* and 1*b* are arranged in pairs and they rotate around the axes of rotation 2*a* and 2*b*. The guide rollers in each pair are coaxial with one another, and the horizontal spacing of the guide rollers 1*a* and the guide rollers 1*b* is the same.

Figure 1:
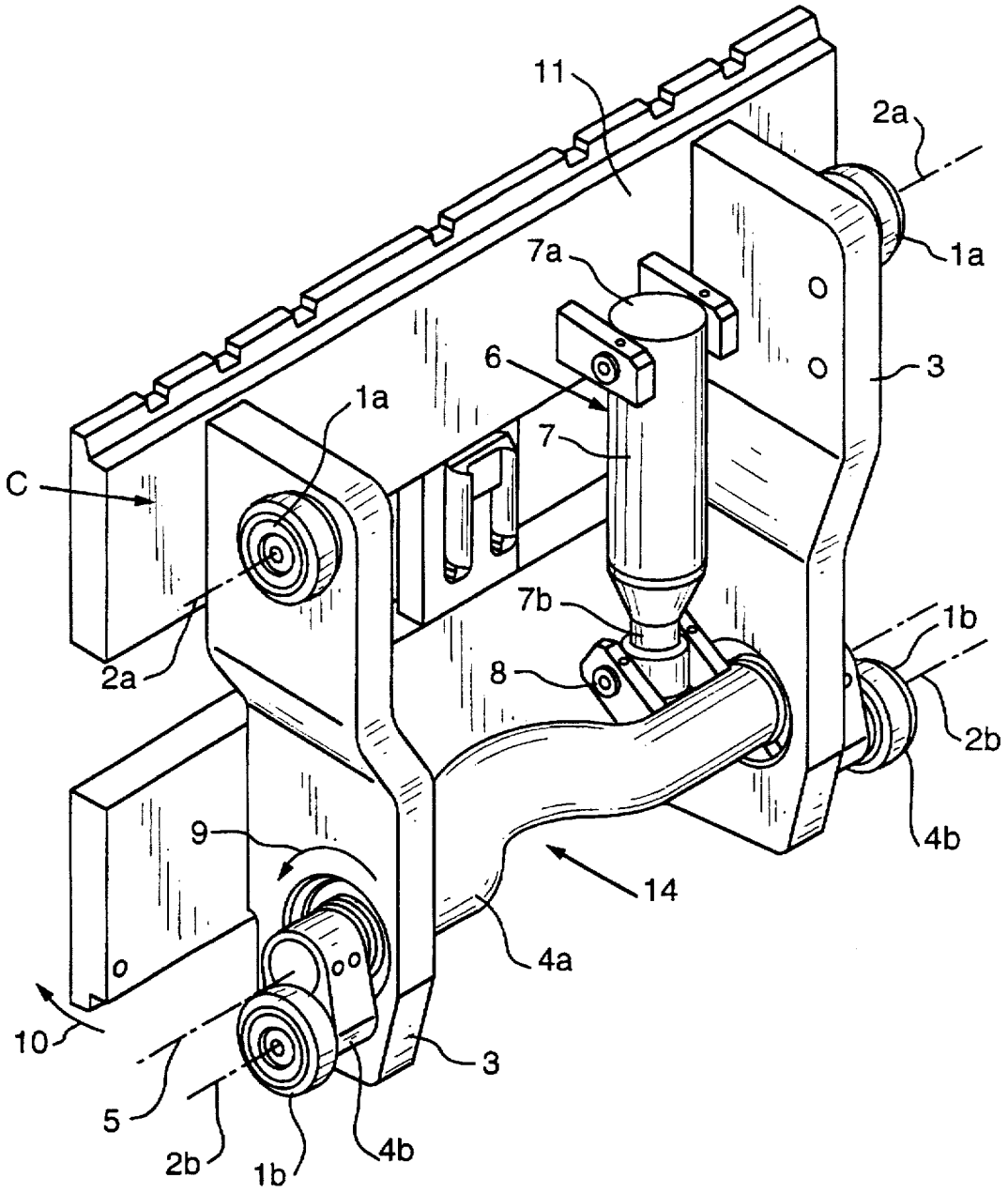
FIG. 1 is a perspective showing a lifting carriage according to the invention.

With reference to FIG. 1 of the drawings, the lifting carriage has spaced substantially parallel legs 3 on which the guide rollers 1*a* are rotatably mounted for rotation around their axis of rotation 2*a*. The guide rollers 1*b* are mounted on an axle body having connected components 4*a* and 4*b*. The guide rollers 1*b* rotate around the axis of rotation 2*b*. The axle body 4*a* and 4*b* rotates relative to the legs 3 of the lifting carriage C around the axis of rotation 5.

A rotation device 6 for applying a rotating force to the axle body 4*a* and 4*b* to rotate the axle body around its axis of rotation 5 is mounted between the spaced legs 3. The rotation device 6 includes a hydraulic cylinder 7 having a cylinder housing 7*a* which is pivotally connected to a bracket fixed to the rear surface of a front plate 11 of the lifting carriage C. A piston rod 7*b* extends from one end of the hydraulic cylinder 7, and the distal end of the piston rod 7*b* is pivotally connected to a crank pin 8 which is connected to a bracket fixed to the axle body 4*a* and 4*b*. The crank pin 8 is spaced from the axis of rotation 5 of the axle body 4*a* and 4*b*.

The axle body 4*a* and 4*b* has a central part 4*a* which extends between and is rotatably mounted on the spaced legs 3 of the lifting carriage C. The crank arms 4*b* of the axle body are fixed to the opposite ends of the central part 4*a* and the guide rollers 1*b* are rotatably mounted on the crank arms. The parts of the axle body 4*a* and 4*b* are non-detachably connected to one another during the assembly of the lifting carriage. The central part 4*a* of the axle body is formed with an indentation or offset portion 14 to prevent contact of the axle body with other components of the industrial truck such as the lifting cylinder, which is located in the vicinity of the lift mast when the axle body is rotated about the axis of rotation 5.

When the axle body is in the position shown in FIG. 1 of the drawings, the piston rod 7*b* of the hydraulic cylinder 7 is almost completely retracted within the cylinder housing 7*a*. When the closed end of the hydraulic cylinder housing 7*a* is supplied with hydraulic fluid through oil pressure lines (not shown), the piston rod 7*b* is extended out of the cylinder housing 7*a* to rotate the axle housing 4*a* and 4*b* about the axis of rotation 5 in the direction of the arrow 9 as a result of the eccentric location of the crank pin 8. The guide rollers 1*b* are thereby moved rearwardly relative to the lifting carriage C along an arcuate path. Since the guide rollers 1*b* are fixed in position in the lifting frame F in the horizontal direction, extension of the piston rod 7*b* from the cylinder housing 7*a* tips the lifting carriage C relative to the lift mast M in the direction of the arrow 10. Tipping the lifting carriage in the direction of the arrow 10 raises the tips of the fork arms (not shown) which are fastened to the fork carrier on a front plate 11 of the lifting carriage C. Analogously, tipping the lifting carriage C in the opposite direction lowers the tips of the fork arms fastened to it.

In the embodiment of the invention shown in FIG. 1 of the drawings, it is possible to tip the lifting carriage from a neutral position in the direction of the arrow 10 to raise the tips of the fork arms. By slightly changing the geometry of the axle body 4*a* and 4*b*, it is possible to tip the lifting carriage C, starting from a neutral position, in the direction of the arrow 10 and in the opposite direction.

Since the entire lifting carriage C is inclined and the lifting carriage is a fork carrier, a fork or fork arms can be connected directly on a front plate 11 of the lifting carriage.

Figure 2:
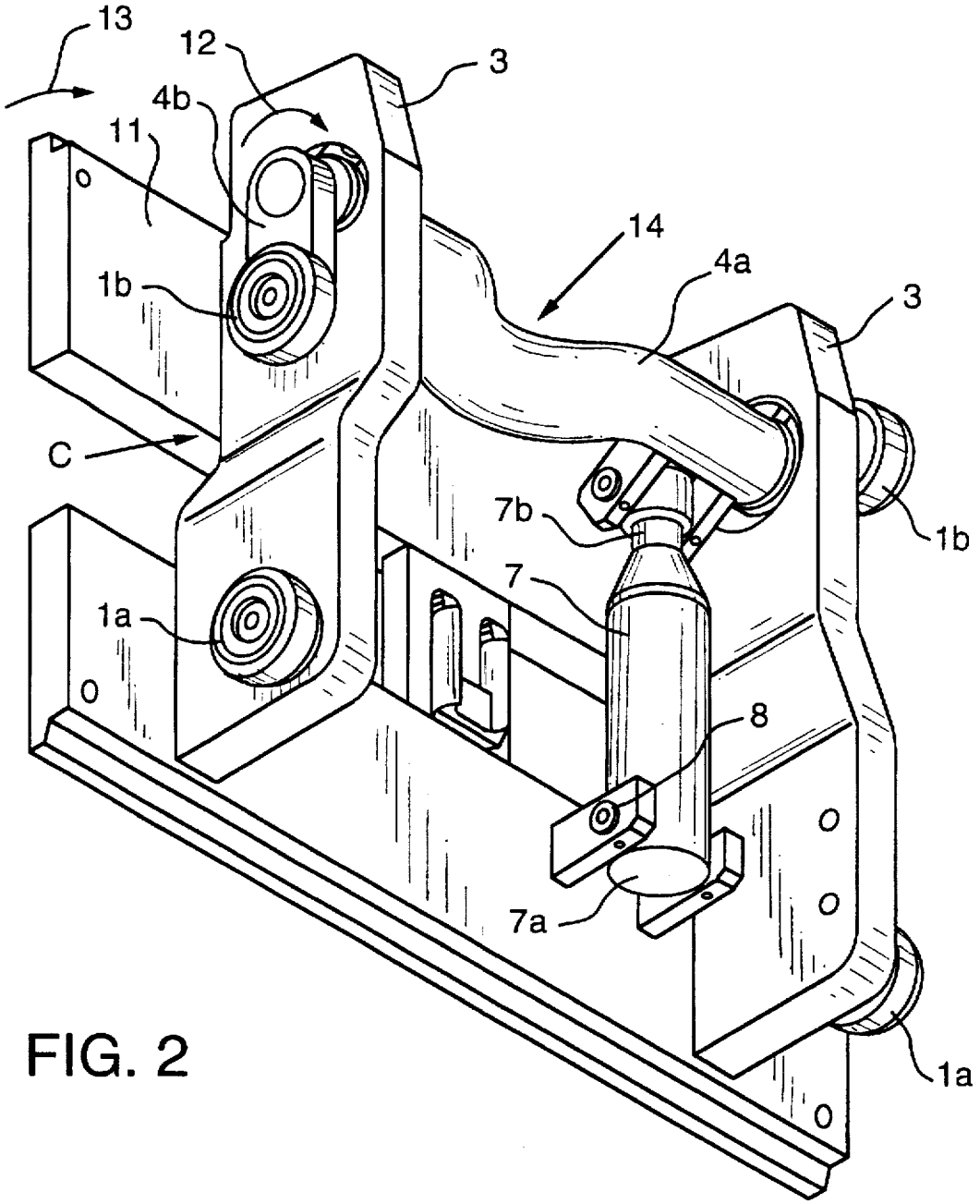
FIG. 2 is a perspective showing a second embodiment of a lifting carriage according to the invention.

In the embodiment of the invention shown in FIG. 2 of the drawings, the axle body 4*a* and 4*b* with the guide rollers 1*b* connected thereto is located above the guide rollers 1*a* which are mounted directly on the lifting carriage. When the piston rod 7*b* is extended from the cylinder housing 7*a*, the axle body 4*a* and 4*b* is rotated in the direction of the arrow 12. Since the guide rollers 1*a* and 1*b* are fixed in position in the horizontal direction in the lifting frame F, the lifting carriage C is inclined or tipped in the direction of the arrow 13. The tips of the fork arms which are fastened to the lifting carriage are raised. The center of gravity of the lifting carriage is shifted toward the lifting frame, which results in a favorable distribution of mass close to the lifting frame.

While different arrangements of the invention are described in detail herein, it will be appreciated by those skilled in the art that various modifications and alternatives to the arrangements can be developed in light of the overall teachings of the disclosure. Accordingly, the particular arrangements are illustrative only and are not limiting as to the scope of the invention which is to be given the full breadth of the appended claims and any and all equivalents thereof.

We claim:

1. A lifting carriage for an industrial truck having a lift mast, said lifting carriage adapted to be connected to a lifting frame for vertical movement along a lift mast, adjustment means mounted on said lifting carriage for adjusting the position of said lifting carriage relative to a horizontal plane, said adjustment means including a first pair of horizontally spaced guide rollers and a second pair of horizontally spaced guide rollers vertically spaced from said first pair of horizontally spaced guide rollers, wherein the position of said guide rollers of said first pair of guide rollers is not movable relative to said lifting carriage and the position of said guide rollers of said second pair of guide rollers is movable relative to said lifting carriage in a direction having a horizontal component of motion relative to said lifting carriage.

2. A lifting carriage as set forth in claim 1, including an axle body rotatably mounted on said lifting carriage for rotation around an axis of rotation wherein said guide rollers of said first pair of guide rollers are rotatably mounted on said axle body for rotation around an axis of rotation, wherein the axis of rotation of said axle body and the axis of rotation of said guide rollers rotatably mounted on said axle body are substantially parallel to one another and are spaced from one another.

3. A lifting carriage as set forth in claim 2, including a rotation device mounted on said lifting carriage for rotating said axle body around its axis of rotation and means for connecting said rotation device to said lifting carriage and to said axle body.

4. A lifting carriage as set forth in claim 2, including a crank pin spaced from the axis of rotation of said axle body and means for connecting said crank pin to said axle body.

5. A lifting carriage as set forth in claim 3, including a crank pin spaced from the axis of rotation of said axle body and means for connecting said crank pin to said axle body.

6. A lifting carriage as set forth in claim 3, wherein said rotation device includes linear actuator means for rotating said axle body about said axis of rotation of said axle body.

7. A lifting carriage as set forth in claim 4, wherein said rotation device includes linear actuator means for rotating said axle body about said axis of rotation of said axle body and means for connecting said linear actuator means to said crank pin.

8. A lifting carriage as set forth in claim 6, wherein said linear actuator means is a hydraulic cylinder having a housing with an end pivotally connected to said lifting carriage and a piston rod having a distal end extending out of said housing and pivotally connected to said axle body.

9. A lifting carriage as set forth in claim 7, wherein said linear actuator means is a hydraulic cylinder having a housing with an end pivotally connected to said lifting carriage and a piston rod having a distal end extending out of said housing and pivotally connected to said axle body.

10. A lifting carriage as set forth in claim 7, wherein said linear actuator is a dual-action hydraulic cylinder.

11. A lifting carriage as set forth in claim 8, wherein said hydraulic cylinder is a dual-action hydraulic cylinder.

12. A lifting carriage as set forth in claim 2, wherein guide rollers mounted on said lifting carriage are adapted to connect said lifting carriage to a lifting frame.

13. A lifting carriage as set forth in claim 3, having spaced substantially parallel legs and at least one of said pairs of guide rollers and said axle body are rotatably mounted on said legs, and said rotation device is located between said spaced legs.

14. A lifting carriage as set forth in claim 2, wherein said axle body has a plurality of parts.

15. A lifting carriage as set forth in claim 1, wherein said guide rollers which are movable relative to said lifting carriage in a direction having a horizontal component of motion are located above said guide rollers which are not movable relative to said lifting carriage.

16. A lifting carriage as set forth in claim 1, wherein said lifting carriage is a fork carrier.

17. A lifting carriage as set forth in claim 16 including at least one fork in said fork carrier.

18. A lifting carriage as set forth in claim 16 including a plurality of forks in said fork carrier.

* * * * *

UNITED STATES PATENT AND TRADEMARK OFFICE

CERTIFICATE OF CORRECTION

PATENT NO. : 5,788,016

DATED : August 4, 1998

INVENTOR(S) : Frank Soulas et al.

It is certified that error appears in the above-identified patent and that said Letters Patent is hereby corrected as shown below:

Title Page, insert:
--[30] Foreign Application Priority Data
Jul. 14, 1995 [DE] Germany.....19525723--.

Claim 10 Column 6 Line 12 after "actuator" insert --means--.

Signed and Sealed this

Twenty-second Day of February, 2000

*Attest:*

Q. TODD DICKINSON

*Attesting Officer*

*Commissioner of Patents and Trademarks*